US011143190B2

(12) United States Patent
Eriksen et al.

(10) Patent No.: US 11,143,190 B2
(45) Date of Patent: Oct. 12, 2021

(54) PUMP ASSEMBLY HAVING AN IMPELLER, A MOTOR, AND A SHAFT, WITH THE SHAFT PASSING FROM THE MOTOR TO THE IMPELLER THROUGH A FLUID RESERVOIR AND A SEAL ARRANGEMNET WITH A TRATION

(71) Applicant: GRUNDFOS HOLDING A/S, Bjerringbro (DK)

(72) Inventors: Gert Friis Eriksen, Bjerringbro (DK); Jens Kjær Milthers, Bjerringbro (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 265 days.

(21) Appl. No.: 16/361,525

(22) Filed: Mar. 22, 2019

(65) Prior Publication Data

US 2019/0293073 A1 Sep. 26, 2019

(30) Foreign Application Priority Data

Mar. 23, 2018 (EP) ..... 18163562

(51) Int. Cl.

| | |
|---|---|
| ***F04D 13/06*** | (2006.01) |
| ***F04D 13/16*** | (2006.01) |
| ***F04D 15/00*** | (2006.01) |
| ***F04D 29/12*** | (2006.01) |
| ***F04D 29/10*** | (2006.01) |

(52) U.S. Cl.

CPC ..... *F04D 13/06* (2013.01); *F04D 13/16* (2013.01); *F04D 15/00* (2013.01); *F04D 15/0077* (2013.01); *F04D 29/106* (2013.01); *F04D 29/108* (2013.01); *F04D 29/126* (2013.01)

(58) Field of Classification Search

CPC ..... F04D 13/06; F04D 29/108; F04D 29/126; F04D 15/0077; F04D 13/16; F04D 15/00; F04D 29/007; F04D 29/106

USPC ..... 417/63; 277/317, 320; 310/68 B

See application file for complete search history.

(56) References Cited

U.S. PATENT DOCUMENTS 3,370,542 A * 2/1968 Harney ..... G01K 13/02 415/47
5,173,019 A * 12/1992 Sdano ..... F04D 15/0263 415/118
5,484,267 A * 1/1996 Rockwood ..... F16J 15/3404 137/563

(Continued)

*Primary Examiner* — Patrick Hamo
*Assistant Examiner* — Benjamin Doyle
(74) *Attorney, Agent, or Firm* — McGlew and Tuttle, P.C.

(57) ABSTRACT

A pump assembly includes an electrical drive motor (2) and an impeller which is connected to the drive motor (2) via a shaft (14). The shaft extends between the drive motor (2) and the impeller, through a seal arrangement with a fluid reservoir (22). A method is provided for detecting a concentration change in a fluid reservoir in the seal arrangement in the pump assembly. A concentration sensor (30) detects a concentration change in the fluid reservoir (22), and a second sensor (32) detects at least one further parameter of the fluid reservoir (22). The sensors are arranged on the fluid reservoir (22). The sensors are connected to an evaluation device (22). The evaluation device (34) is configured to carry out an evaluation of at least one reading of the concentration sensor (30), taking into account at least one reading which is detected by the second sensor (32).

23 Claims, 5 Drawing Sheets

(56) References Cited

U.S. PATENT DOCUMENTS

| | | | | |
|---|---|---|---|---|
| 5,906,374 | A * | 5/1999 | Arbuckle | F16K 37/0091 277/304 |
| 6,250,876 | B1 * | 6/2001 | Høgholt | F04D 29/128 415/17 |
| 6,379,127 | B1 * | 4/2002 | Andrews | F04D 13/083 277/387 |
| 6,626,436 | B2 * | 9/2003 | Pecht | F16J 15/3492 277/317 |
| 2003/0211626 | A1 | 11/2003 | Davenport et al. | |
| 2013/0272898 | A1 * | 10/2013 | Toh | F04D 13/10 417/44.1 |
| 2014/0116513 | A1 * | 5/2014 | Nguyen | C08F 2/01 137/1 |
| 2016/0084069 | A1 * | 3/2016 | Camacho Cardenas | F04D 29/528 415/118 |
| 2017/0081997 | A1 * | 3/2017 | Potyrailo | G01N 27/026 |

* cited by examiner

PUMP ASSEMBLY HAVING AN IMPELLER, A MOTOR, AND A SHAFT, WITH THE SHAFT PASSING FROM THE MOTOR TO THE IMPELLER THROUGH A FLUID RESERVOIR AND A SEAL ARRANGEMNET WITH A TRATION

CROSS REFERENCE TO RELATED APPLICATIONS

This application claims the benefit of priority under 35 U.S.C. § 119 of European Application 18163562.4, filed Mar. 23, 2018, the entire contents of which are incorporated herein by reference.

TECHNICAL FIELD

The invention relates to a pump assembly as well as to a method for monitoring or detecting a concentration change in a fluid reservoir (sometimes called fluid chamber/receiver or liquid seal) in a seal arrangement in a pump assembly.

BACKGROUND

Concerning centrifugal pump assemblies with a dry-running electrical drive motor, it is necessary to seal the pump chamber with the impeller which rotates therein, with respect to the drive motor. The drive shaft is led through a seal arrangement for this. Here, it is known to use two seals which are distanced to one another, with a fluid reservoir which is arranged therebetween. Such fluid reservoirs can be filled for example with oil or with a glycol-water mixture. If now the first seal which faces the pump chamber should fail, the fluid to be delivered, for example water, penetrates into the fluid reservoir. It is desirable to be able to detect this in good time, in order to be able to replace the seal. Concerning oil reservoirs, sensors which can recognize penetrating water are known. However, it is significantly more difficult to be able to detect penetrating water when using a glycol-water mixture in the fluid reservoir. It is necessary to detect a change of the water concentration for this. This is often not possible without further ado due to the changing operating conditions and changing ambient conditions.

SUMMARY

It is an object of the invention to provide an improved pump assembly as well as a method for monitoring a fluid reservoir in a seal arrangement of a pump assembly, which reliably permit the detection of penetrating fluid in a fluid reservoir.

The pump assembly according to the invention comprises an electrical drive motor and at least one impeller, said impeller being connected to the drive motor via a shaft. Here, the shaft extends through at least one seal arrangement between the drive motor and the impeller. This seal arrangement comprises fluid reservoir. For this, the seal arrangement preferably comprises at least two seals, between which the fluid reservoir in the form of a chamber filled with fluid is formed. The fluid reservoir serves for recognizing leakages and the prevention of a direct penetration of water into the dry motor space. The fluid in the chamber can moreover serve for cooling. The electrical drive motor is preferably configured in a dry-running manner in the case of such a design. I.e. the seal arrangement is located between the pump chamber which is filled with fluid and in which the impeller rotates, and the electrical drive motor which is situated in the dry space. In particular, the pump chamber can be filled with water if the pump assembly is configured for delivering water, for example fresh water or waste water.

According to the invention, at least one concentration sensor for detecting a concentration change in the fluid reservoir is formed on the fluid reservoir. The concentration sensor for example can be configured to detect the concentration of a second fluid in a first fluid of the fluid reservoir, in particular the concentration of water in glycol or vice versa. However, other fluid mixtures can also be used, in particular mixtures of more than two fluids. Thus possibly further additives are contained in an oil-glycol mixture. The concentration sensor is configured to detect changes of an initially set concentration of the different fluids in the fluid reservoir. The concentration sensor can be configured such that it immerses into the fluid or detects the concentration from the outside in a contact-free manner, e.g. through a separating wall. According to the invention, at least one second sensor for detecting at least one further parameter of the fluid reservoir is moreover arranged on or in the fluid reservoir. The concentration sensor as well as the at least one second sensor are connected to an evaluation device in a manner such that the evaluation device receives the readings (measured values) which are detected by the sensors and can further process these readings.

The evaluation device can be integrated into an electronic control or regulation device which is arranged directly on the pump assembly, in particular a control device for the control or regulation of the drive motor. For this, the evaluation device can be arranged for example in an electronics housing of the pump assembly. However, it is also possible to design the evaluation device as a separate electronics component or however to arrange it more remotely from the sensor device or the pump assembly, for example is a cloud-implemented or network-implemented evaluation device. The evaluation device or parts of the evaluation device can also be integrated directly into the sensor or a sensor housing of the first and/or second sensor. It is also conceivable to distribute the functionality of the evaluation unit onto several electronic units or processors in different components.

According to the invention, the evaluation device is configured such that it carries out an evaluation of at least one reading of the concentration sensor whilst taking into account at least one reading which is detected by the at least one second sensor. This has the advantage that changes of the operating condition which have an influence upon the reading of the concentration sensor and which could adulterate the result of the measurement of this can be detected and taken into account which is to say compensated. The parameter which is detected by the second sensor can thus be a parameter which characterizes a certain operating condition or characterized changes of the operating conditions and/or ambient conditions. This permits the changes of the reading of the concentration sensor to be compensated or corrected on the basis of the readings of the at least one second sensor, so that a more precise measurement of the concentration becomes possible. It is to be understood that one could also provide several second sensors or a second sensor which simultaneously detects more than one parameter. The second sensor can thus detect for example the temperature and/or the pressure or also alternatively or additionally vibrations and/or solid-borne noise.

The at least one second sensor is preferably a temperature sensor or a sensor which detects at least one temperature-dependent parameter. Such a temperature-dependent parameter can be an arbitrary parameter which is dependent on the temperature, in particular is proportional to the temperature. Such a temperature-dependent parameter therefore permits an indirect temperature detection.

The evaluation device is particularly preferably configured such that it carries out an evaluation of at least one reading of the concentration sensor whilst taking into account at least one temperature reading or temperature-dependent parameter, which is detected by the at least one second sensor. In particular, the evaluation device, as already described beforehand, is configured such that it corrects or compensates the reading of the concentration sensor on the basis of the temperature reading or of the temperature-dependent parameter, which is detected by the at least second sensor. The influence of the temperature upon the concentration measurement can therefore be eliminated. Here, an acquired temperature reading or however a parameter which is dependent on the temperature, for example a vibration signal, can form the basis of this correction in a direct manner. A direct or an indirect temperature-dependent compensation is thus effected.

The concentration sensor is preferably configured as an ultrasound sensor, as an optical sensor or as a capacitive sensor. Regarding an ultrasound sensor, an ultrasound generator, for example a piezo-element is preferably configured and arranged on the fluid reservoir such that it sends an ultrasound signal into the fluid reservoir, said signal then being reflected at an opposite wall. The reflected signal is received by a measuring sensor which can preferably likewise be formed by the sound generator or however be integrated with this into a construction unit. The speed of sound and hence the received reflected ultrasound signal changes given a change of the concentration, so that concentration changes can be ascertained by the evaluation device. The speed of sound is not only dependent on the concentration, but likewise on the temperature of the medium, which is why it is preferable to detect the temperature with the help of the at least one second sensor and to moreover carry out a compensation of the detected ultrasound signal.

The ultrasound sensor, as described above, can therefore be a sensor which operates according to the reflection principle. Alternatively however, one can also use an ultrasound sensor, concerning which a transmitter is arranged at one side and a receiver at the opposite side, without the signal being reflected at a reflector.

A first possible consideration of different operating conditions on detecting concentration changes by way of the concentration sensor can be effected in a manner such that the evaluation device is configured such that it only carries out an evaluation of a reading of the concentration sensor if the reading which is detected by the at least one second sensor and in particular a temperature reading which is detected by the second sensor lies below a defined maximal limit value, preferably a defined maximal temperature limit value. I.e. for example, the concentration measurement can be skipped above a certain operating temperature, at which reliable measuring results can no longer be expected.

Alternatively or additionally, the evaluation device can be configured in a manner such that it only carries out an evaluation of a reading of the concentration sensor if the reading which is detected by the at least one second sensor and in particular a temperature reading which is detected by the second sensor lies above a predefined minimal limit value, i.e. preferably above a defined minimal temperature limit value. Hence one can ensure for example that the concentration measurement is completely skipped at temperatures which are too low and at which an unadulterated measuring result is not to be expected.

According to a possible embodiment of the invention, the evaluation device is configured such that on the basis of a reading which is detected by the concentration sensor, the evaluation device outputs an alarm signal if this at least one measured value or a characteristic value which is derived from the measured value reaches a predefined concentration limit. Additionally, the evaluation device may emit a switching or control signal which can be detected by a control device and used to switch off the pump assembly on the basis of this signal, in order to prevent further defects. Then, on the basis of the alarm signal, one can ascertain that an exchange of the seals in the seal arrangement is necessary. In particular, the evaluation device can be configured such that it can detect a breakage or a complete destruction of the shaft seal e.g. on the basis of the magnitude of the concentration change and/or of the speed of the concentration change and outputs an alarm signal given a corresponding detection of a breakage of the shaft seal.

According to a further preferred embodiment, the evaluation device is configured to form at least one characteristic value which is derived from the reading of the concentration sensor and from a reading, in particular a temperature reading, which is detected by the at least one second sensor. Such a characteristic value can be a concentration reading which is corrected by the influence of the temperature, i.e. a concentration reading which was corrected such that a temperature-dependent influence upon the measurement result was eliminated or reduced. A decision concerning the condition of the fluid reservoir can then be made on the basis of such a characteristic value, and in particular the characteristic value can be compared to a defined limit value for the concentration, and an error signal can be issued on exceeding or falling short of this limit value, said signal then signalizing a servicing or repair of the seals.

The evaluation device can therefore preferably be configured such that its skips a reading acquisition or reading evaluation for the concentration, for example given too high and/or too low a temperature which is detected by the second sensor. Herein, the evaluation device is further preferably configured such that given the skipping of a reading acquisition or reading evaluation, it takes the last reading which was detected before the skipping as a basis for the further processing. This means that in such a case, the evaluation device outputs for example the last validly detected reading as the concentration value.

According to a further preferred embodiment, the evaluation device can be configured such that it acquires readings of the concentration sensor at different points in time and forms an average value of the detected readings as a characteristic value. Short-term fluctuations which are attributed for example to changes of the operating condition of the pump assembly can be minimized by way of the formation of the average, and only long-term influences can be taken into account, in order to deduce changes of the fluid reservoir which render a service or repair of the seals necessary.

Particularly preferably, the evaluation device can thereby be configured such that it forms a rolling average value or an average value over a certain time span, as a characteristic value. Here, the certain time span can be for example a certain time span which lies before the current point in time. Thus for example, starting from the current point in time, a rolling average value can be formed for certain past time interval or a new average value can be formed at regular intervals, as a characteristic value. Long-term changes of the characteristic value can hence be acquired, whereas short-term fluctuations are eliminated due to the formation of the average value.

According to a further preferred embodiment of the invention, the evaluation device is configured such that upon forming the average value, the evaluation device weights the readings of the concentration sensor in dependence on the readings which are detected by the at least one second sensor and preferably in dependence on the temperature readings which are detected by the second sensor and/or in dependence on the time. Thus on forming the average, for example concentration readings in operating conditions, in which a more accurate measurement of the concentration is to be expected can be weighted higher than readings in operating conditions of the pump assembly, in which less accurate measurements are to be expected. The operating conditions are herein represented by the reading which is detected by the second sensor. In particular, these can be operating conditions at different temperatures or different temperatures of the fluid reservoir, which are detected directly or indirectly by the second sensor as described above. Concentration readings in temperature ranges which permit a more accurate detection of the concentration are weighted higher than concentration readings which have been detected at other temperatures. Moreover, for example more recent readings can be weighted more greatly than readings which lie further back. A temporal detection is also possible in the manner such that in the case that a detection or evaluation of the reading is skipped at temperatures which are too high or too low, the last reading before the skipping is used. A warning signal or hint signal that a correct measurement could not be carried out for a longer time can be possibly simultaneously issued.

Particularly preferably, the evaluation device can be configured in a manner such that on forming the average value, readings, i.e. concentration readings which are detected at a lower temperature are weighted higher than readings which were detected at a higher temperature. This is effected for example according to a linear function or an inverse Sigmoid function. However, other mathematical functions can also be applied in order to achieve this. Basically, for example, monotonically descending functions can be used in certain temperature intervals, such as for example the previously mentioned linear functions and the inverse Sigmoid function. However, it is also possible to apply monotonically ascending functions in certain temperature regions, in particular at very low temperatures which lie close to the freezing point. A monotonically descending function can therefore be applied in a higher temperature range and a monotonically ascending function in a lower temperature range.

The greater weighting of the readings which are detected at a lower temperature is particularly preferred on using an ultrasound sensor, since at lower temperatures, the concentration changes lead to a greater change of the speed of sound through the medium, from which a greater measuring accuracy results. The speed difference becomes smaller at higher temperatures, so that greater measurement inaccuracies can be given in these regions.

Alternatively or additionally, the evaluation device can comprise a neuronal network for evaluating the at least one reading. Such a neuronal network has the advantage that a learning evaluation is possible, and such an evaluation adapts itself to changes of the operating conditions and ambient conditions in an ongoing manner, by which means the evaluation of the reading from the concentration sensor can be improved and increased in accuracy in an ongoing manner.

According to a possible embodiment of the invention, the concentration sensor and the at least one second sensor can be integrated into a sensor construction unit. This is particularly the case if the concentration sensor is an ultrasound sensor and the at least one second sensor is a temperature sensor. An integrated sensor construction unit which as a whole can be easily integrated into the pump assembly can therefore be created. In particular, it is also possible to use common electrical connections for the concentration sensor and the at least one second sensor and possibly to also carry out the data transmission via common leads.

According to a further possible embodiment of the invention, at least one third sensor is provided, said third sensor being configured to detect an operating condition of the pump assembly. In particular, this at least one third sensor can be configured such that it detects whether the pump assembly is in operation or not. The at least one third sensor can be for example a vibration sensor or a structure-borne sound sensor for this. The operating condition and in particular as to whether the pump assembly is switched on or off can be very easily detected from a vibration signal or structure-borne sound signal. The evaluation device is thereby preferably configured such that it only carries out an evaluation of the signal of the concentration sensor in predefined operating conditions, for example when the pump assembly is switched off This can improve the measuring result. For example, air bubbles in the fluid reservoir can occur during operation and these can adulterate the measuring result. Such can be detected by the arrangement of a third sensor in the described manner, so that e.g. the evaluation of a signal of the concentration sensor is only effected in those cases, in which no compromising of the measuring result is to be expected.

As described above, the fluid reservoir is preferably filled with a fluid mixture which contains oil and glycol. In particular, the fluid mixture can contain a mixture of glycol and water. The concentration sensor and the evaluation device are preferably configured for detecting the concentration of water in the fluid reservoir, so that a penetration of water can be detected and thus a warning notice can be produced if the seal which faces the pump chamber becomes leaky.

Particularly preferably, the pump assembly is a water pump assembly and further preferably a waste water pump assembly. Such pump assemblies can be configured as submersible pumps and it is important for the motor space, in which the dry-running electrical drive motor is arranged, to be sealed off in a reliable manner.

According to a further possible embodiment, the evaluation device is configured to compute or predict a time interval until the next due service of the pump assembly on the basis of the evaluation of the readings of the concentration sensor. Herein, a service is to be understood for example as the exchange of a seal, which is to say of a shaft seal. The evaluation device or a control device which is connected to the evaluation device can estimate the point in time of the next due service. This can be effected on the basis of an extrapolation based on the previously acquired measurements of the concentration sensor. For example, a sudden increase can occur from essentially constant measured values, and this would indicate that a seal is to be exchanged in the near future. Here, an exponential tendency which can be taken into account by the evaluation device and a connected control device can be present.

Apart from the described pump assembly, the subject-matter of the invention is moreover a method for detecting a concentration change in a fluid reservoir in a seal arrangement in a pump assembly, concerning which at least one reading of a concentration sensor which is arranged on the fluid reservoir is evaluated in dependence on at least one further parameter of the fluid reservoir and preferably in dependence on the temperature or of a temperature-dependent parameter, of the fluid reservoir. It is particularly an influence of the temperature upon the measuring result of a concentration sensor which can be compensated in this manner. This can be effected in the manner which is described above by way of a pump assembly. The preceding description of the pump assembly is referred to with regard to preferred method steps. Procedures or course of the method which are described there or method courses which result from the design of the pump assembly are likewise preferably the subject-matter of the method according to the invention.

Particularly preferably, with regard to the method according to the invention, the evaluation of the at least one reading of the concentration sensor is skipped when the temperature of the fluid reservoir lies above an upper limit value or below a lower limit value. One can therefore rule out readings which were recorded at environment conditions which permit no accurate measurement being taking into consideration of detecting or acquiring the concentration.

Particularly preferably, with regard to the method according to the invention, on evaluation, an average value is formed from a plurality of readings of the concentration sensor, wherein further preferably the individual readings are weighted differently depending on a further parameter and preferably in dependence on the respectively detected temperature and/or in dependence on time. In particular, readings which were acquired at a lower temperature can be weighted more greatly, as has been described above by way of the pump assembly.

The invention is hereinafter described by way of example and by way of the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
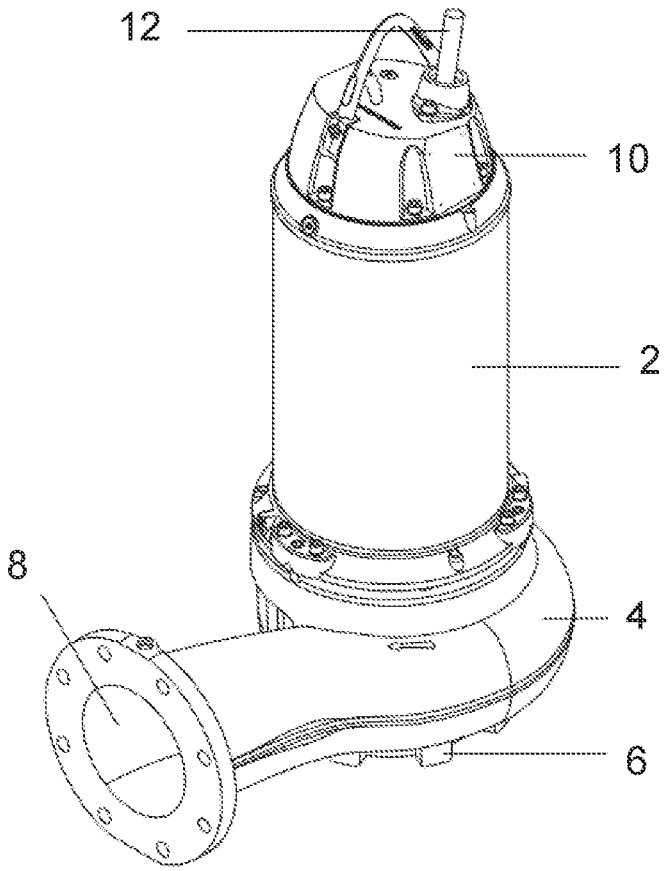
FIG. 1 is a perspective view of a pump assembly according to the invention.
Figure 2:
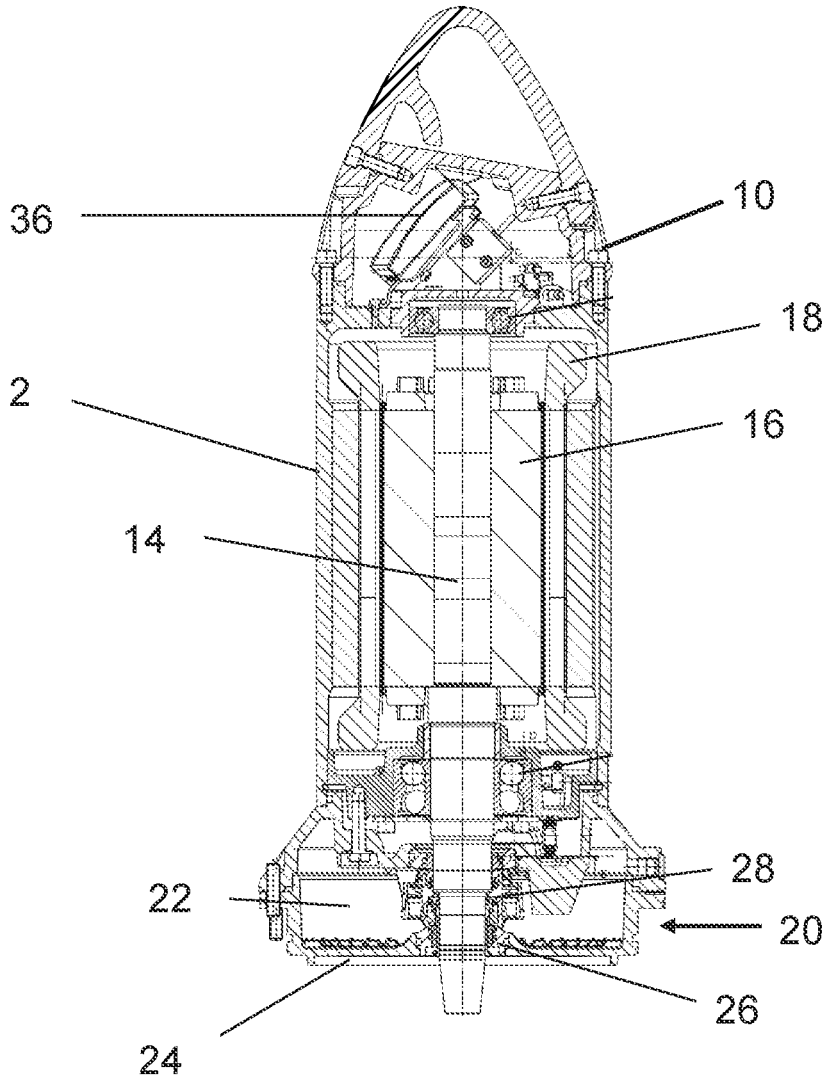
FIG. 2 is a sectioned view of the drive motor of the pump assembly according to FIG. 1.

Referring to the drawings, the pump assembly according to the invention which is represented by way of example in FIGS. 1 and 2 is configured as a submersible pump assembly. The pump assembly in the known manner comprises an electrical drive motor 2 with an applied or attached pump casing 4. The pump casing 4 at its lower side comprises an inlet opening 6 as well as a radial delivery branch 8 which is to say delivery pipe connection. The drive motor 2 at its axial end which is away from the pump casing 4 comprises a terminal box or an electronics housing 10, in which control and regulation electronics for the drive motor 2 can be arranged and/or the electrical connection to a connection lead 12 for the energy supply can be created.

The pump casing 4 in its inside and in the usual manner comprises a pump chamber, in which an impeller (not shown here) rotates. The impeller is connected to the drive shaft or shaft 14 of the drive motor 2 in a rotationally fixed manner. The shaft 14 is connected to the rotor 16 of the drive motor 2 in a rotationally fixed manner in the drive motor 2, said rotor rotating in the inside of the stator 18 in the known manner. The drive motor 2 is configured as dry-running motor, i.e. the interior of the drive motor 2 is completely sealed with respect to the pump chamber in the inside of the pump casing 4, for which the shaft 14 is led through a seal arrangement 20. The seal or sealing arrangement 20 comprises a fluid reservoir 22 in the inside of a chamber which is delimited by a seal housing 24. The seal arrangement 20 moreover comprises two seals 26 and 28 which are configured as shaft seals and through which the shaft 14 is sealingly led. The seal 26 forms a first seal which faces the pump casing 4, whereas the seal 28 forms a second seal which faces the drive motor 2. The fluid reservoir 22 is situated between the first seal 26 and the second seal 28. If the first seal 26 were now to fail, then fluid from the pump casing 4 would penetrate into the inside of the fluid reservoir 22, which can be detected. According to expectations, the first seal 26 would tend to wear more rapidly than the second seal 28, by which means the wearing of the seal can be recognized before fluid from the fluid reservoir 22 penetrates into the inside of the drive motor 2. The construction of the fluid reservoir 22 is hereinafter described in more detail by way of FIG. 3.

Figure 3:
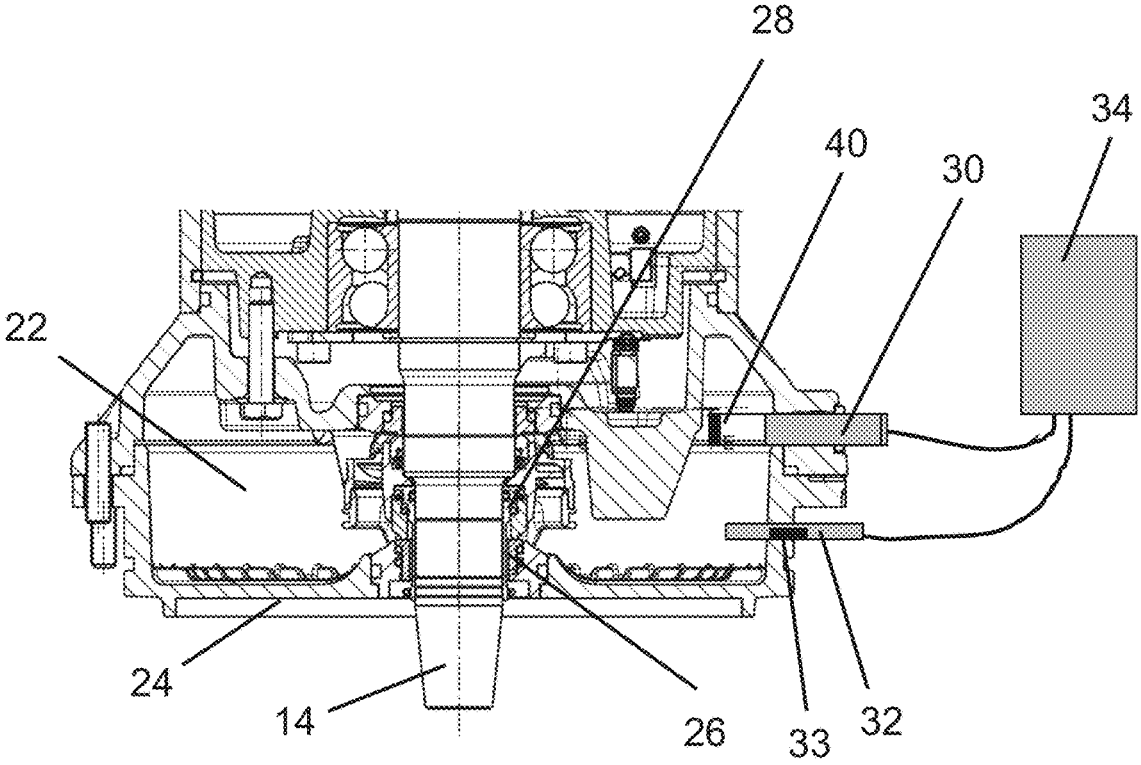
FIG. 3 is an enlarged sectioned view of the seal arrangement on the drive motor according to FIG. 2.

The fluid reservoir 22 can preferably be filled with a fluid mixture which contains oil or glycol, in particular with a glycol-water mixture. Here, the mixture can yet comprise further additives, apart from glycol and water. If water from the pump chamber in the inside of the pump casing 4 penetrates through the first seal 26 into the fluid reservoir 22, then the glycol-water concentration in the fluid reservoir 22 changes. This is detected by a concentration sensor 30 which is inserted into the seal housing 24 of the seal arrangement 20. The concentration sensor 30 extends into the inside of the chamber, in which the fluid reservoir 22 is located. A second sensor 32 which in this case is configured as a temperature sensor is additionally arranged on the seal housing 24. However, the second sensor 32 can also be configured as a combined sensor which detects several parameters, for example temperature and pressure and/or vibrations. As represented in FIG. 3, a vibration sensor 33 as a third sensor can thus be integrated in the second sensor. The vibration sensor 33 serves for recognizing whether the pump assembly is in operation or not. The concentration sensor 30 as well as the second sensor 32 is connected to an evaluation device 34. The evaluation device 34 comprises one or more processors and associated memory. The output signals of the vibration sensor 33 are also evaluated by the evaluation device 34, in order for example to skip the evaluation of the other sensor given vibrations which are too large. The evaluation device 34 can be part of control and regulation electronics 36 in the inside of the electronics housing 10 (see FIG. 2), said electronics controlling the drive motor 2.

Figure 4:
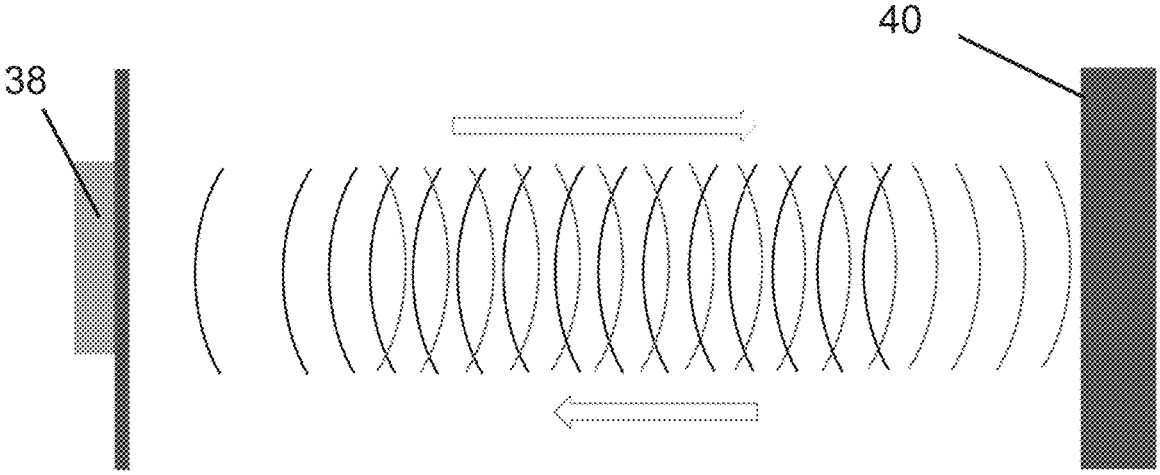
FIG. 4 is schematic view showing the concentration measurement by way of ultrasound.

In this embodiment example, the concentration sensor 30 is configured as an ultrasound sensor as is described by way of FIG. 4. The concentration sensor 30 comprises an emitting/receiving unit 38 which emits an ultrasound signal into the inside of the fluid reservoir 22 to an opposite wall 40. The signal is reflected at the wall 40 and is sent back to the emitting/receiving unit 38, at which the signal is received again. The emitting/receiving unit 38 is connected to the evaluation device 34 which can detect the signal propagation time of the ultrasound signal between the emitting/receiving unit 38 and the wall 40. The speed of sound of the fluid reservoir 22 changes depending on the concentration, so that changes of the concentration can be detected by the evaluation unit 34 from the propagation time and thus from the speed of the signal in the fluid reservoir 22. The emitting/receiving unit 38 can be configured for example as a piezoelement.

Figure 5:
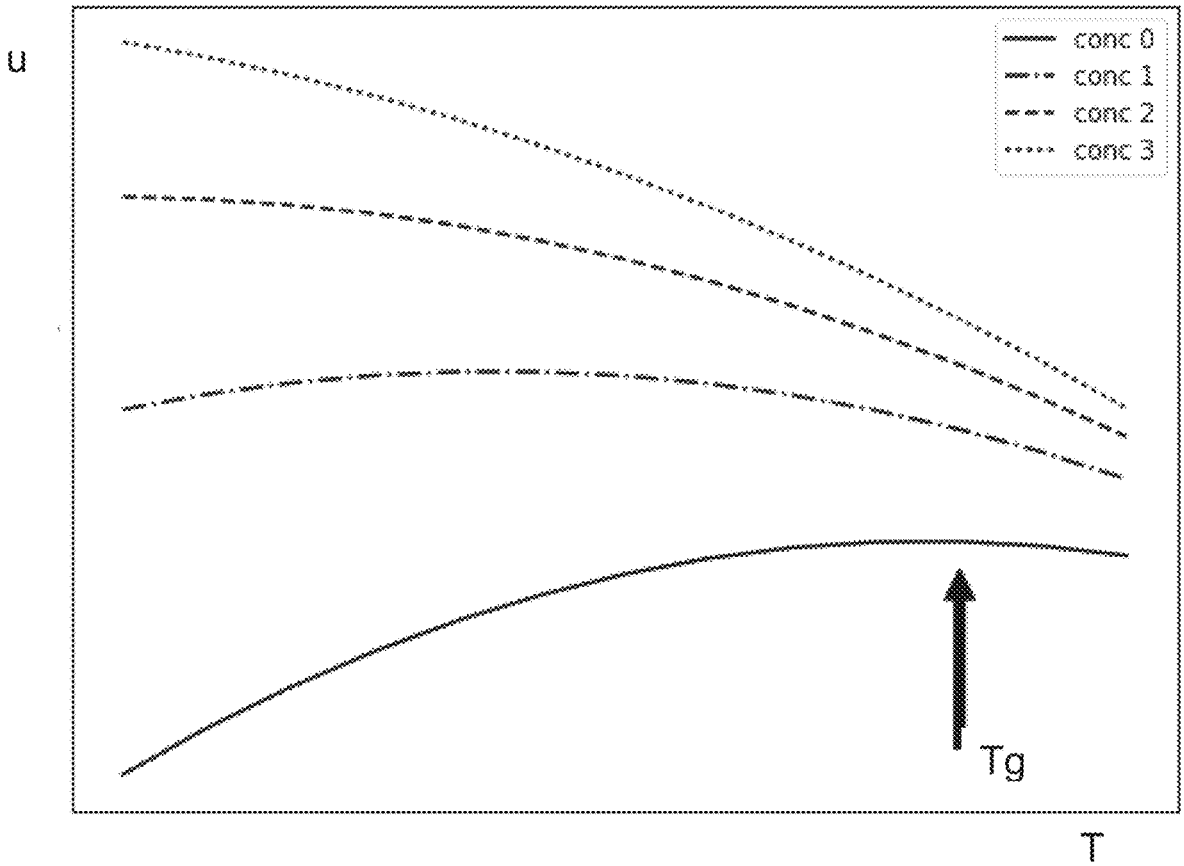
FIG. 5 is a graph showing the speed of sound in the fluid reservoir in dependence on the temperature, for different concentrations.

Signal courses for the signal speed within the fluid reservoir 22 are represented in FIG. 5 for four different concentrations conc0, conc1, conc2 and conc3. Here in FIG. 5, the speed u is plotted against temperature T. One can recognize that the speed differences between the individual concentrations reduce with an increasing temperature T. I.e. the measuring accuracy of the concentration decreases with an increasing temperature. A precise measurement is no longer possible from a temperature limit value $T_g$. For this reason, according to the invention, one envisages the evaluation device 34 preferably skipping the evaluation of the measuring result of the concentration sensor 30 on exceeding the temperature $T_g$. As a rule, a waste water pump is not operated in a continuous manner, but in intervals. The temperature increases on operation. The temperature reduces again when the pump is then switched off again, so that on operation it is possibly regularly the case that the temperature limit value $T_g$ is exceeded, but is subsequently fallen short of. The concentration measurement or evaluation of the reading of the concentration sensor 30 is then only carried out by the evaluation device 34 for measurements at temperatures below the temperature limit value $T_g$.

Figure 6:
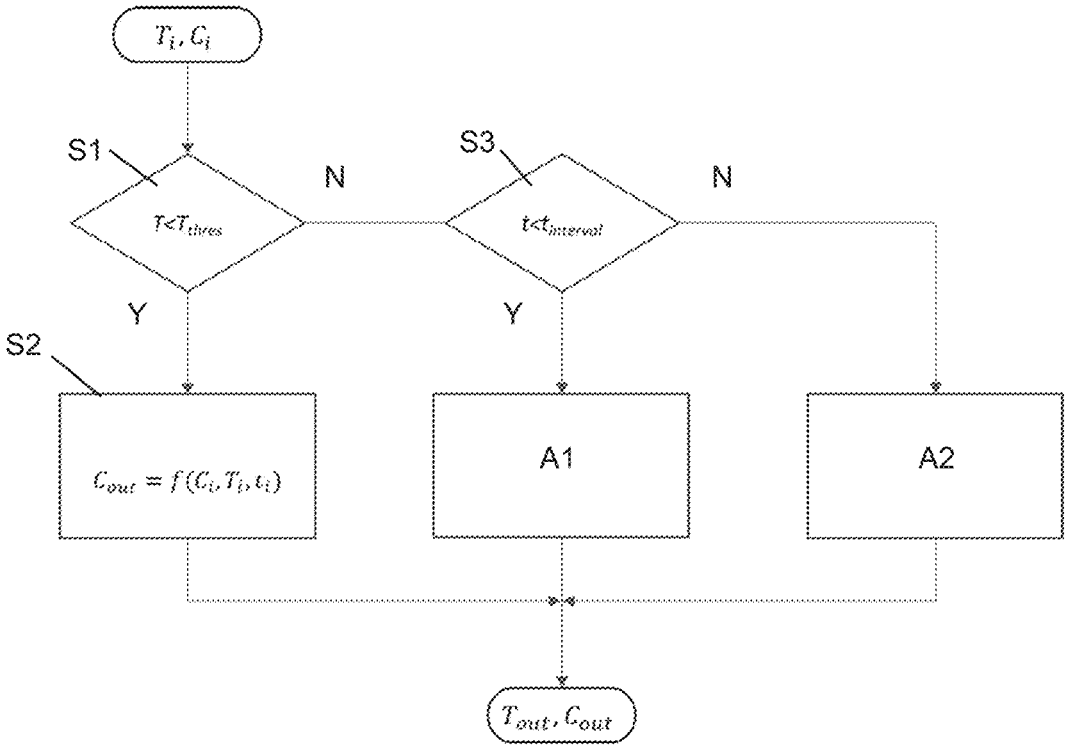
FIG. 6 is a schematic view showing the course of preferred embodiment of the method according to the invention.

The evaluation of the concentration in the fluid reservoir 22 can be effected by the evaluation device 34 for example in the manner which is described by way of FIG. 6. A current concentration $C_i$ is detected by the concentration sensor 30, as well as a current temperature $T_i$ by the temperature sensor 32, as input values. In step S1, it is examined as to whether the current temperature value T lies below a limit value $T_{thres}$ (corresponds to $T_g$). In this is the case (Y), then a corrected concentration value $C_{out}$ as a function of the measured concentration values $C_i$, of the measured temperature values $T_i$ as well as of the time ti is determined in step S2. Thus for example the concentration $C_{out}$ can be determined as a weighted average value of a multitude of concentrations $C_i$ which are measured of a longer period of time, in particular as a rolling average. The weighting can be effected in a time-dependent and/or temperature-dependent manner. In particular, the weighting is preferably effected such that measurements at lower temperatures are weighted higher than measurements at higher temperatures. This can be effected according to a linear function or also a reverse Sigmoid function or other suitable mathematic functions.

If it should be ascertained in Step S1 that the temperature $T_i$ lies above the set temperature limit value $T_{thresh}$ (N), then in step S3 it is examined as to whether the time period t since the last evaluation of the concentration value $C_{out}$ is smaller than a defined interval $t_{interval}$. If this is the case (Y), then in Step A1 $C_{out}$ is set to the last determined value. If it is ascertained in Step S3 that the time interval t is the same or larger than the predefined interval $t_{interval}$ (N), then in step A2 the concentration value $C_{out}$ is set the last determined value and a warning notice to the effect that no current (present) measurement or determining of the concentration is possible is simultaneously issued.

The determining of the concentration $C_{out}$ (estimated or corrected concentration) on the basis of the temperature $T_i$ and the measured concentration value $C_i$ can also be effected in a different manner, for example amid the use of a neuronal network. Such a neuronal network could adapt to changes of the ambient conditions and operating conditions, and in a learning manner adapt the correction of the concentration readings $C_i$ in dependence on the temperature.

Other algorithms or methods can also be used, in order to correct or adapt the concentration readings $C_i$ in a temperature-dependent manner, in order to reduce or eliminate the influence of the temperature upon the concentration measurement.

While specific embodiments of the invention have been shown and described in detail to illustrate the application of the principles of the invention, it will be understood that the invention may be embodied otherwise without departing from such principles.

APPENDIX

List of Reference Designations

2—drive motor
4—pump casing
6—inlet opening
8—delivery pipe connection
10—electronics housing value
12—connection conduit
14—shaft
16—rotor
18—stator
20—seal arrangement
22≤fluid reservoir
24—seal housing
26—first seal
28—second seal
30—concentration sensor
32—second sensor/temperature sensor
33—third sensor/vibration sensor
34—evaluation device
36—control electronics
38—emitting/receiving unit
40—wall
$T_g$, $T_{thres}$—temperature limit
t—time
T—temperature
C—concentration

What is claimed is:

1. A pump assembly comprising:

an electrical drive motor;

at least one seal arrangement with a fluid reservoir;

a shaft;

at least one impeller connected to the drive motor via the shaft, wherein the shaft extends between the drive motor and the impeller, through the at least one seal arrangement with the fluid reservoir;

a concentration sensor for detecting a fluid concentration change in the fluid reservoir, the concentration sensor being arranged in operative communication with the fluid reservoir;

a second sensor for detecting a further parameter of the fluid reservoir, the second sensor being arranged in operative communication with the fluid reservoir; and an evaluation device connected to each of the concentration sensor and the second sensor, the evaluation device being configured to carry out an evaluation of at least one reading of the concentration sensor taking into account at least one reading by the second sensor.

2. A pump assembly according to claim 1, wherein the second sensor is a temperature sensor or a temperature-dependent parameter sensor which detects at least one temperature-dependent parameter.

3. A pump assembly according to claim 1, wherein the evaluation device is configured to carry out an evaluation of the at least one reading of the concentration sensor, taking into account the at least one temperature reading or temperature-dependent parameter reading, which is detected by the second sensor.

4. A pump assembly according to claim 1, wherein the concentration sensor comprises an ultrasound sensor, an optical sensor or a capacitive sensor.

5. A pump assembly according to claim 1, wherein the evaluation device is configured to only carry out an evaluation of the at least one reading of the concentration sensor when the at least one reading which is detected by the second sensor lies below a defined maximal limit value.

6. A pump assembly according to claim 1, wherein the evaluation device is configured to only carry out an evaluation of a reading of the concentration sensor when the reading which is detected by the second sensor lies above a defined minimal limit value.

7. A pump assembly according to claim 1, wherein the evaluation device is configured such that with a skipping of a reading acquisition or reading evaluation, the evaluation device takes a last reading, which was detected before the skipping, as a basis for further processing.

8. A pump assembly according to claim 1, wherein the evaluation device is configured to output an alarm signal based of the at least one reading which is detected by the concentration sensor, if the at least one reading or a characteristic value which is derived from the reading reaches a predefined concentration limit value.

9. A pump assembly according to claim 1, wherein the evaluation device is configured to form at least one characteristic value which is derived from the at least one reading of the concentration sensor and from at least one reading detected by the second sensor.

10. A pump assembly according to claim 1, wherein the evaluation device is configured to detect readings of the concentration sensor at different points in time and form an average value of the detected readings as a characteristic value.

11. A pump assembly according to claim 10, wherein the evaluation device is configured to forms a rolling average value or an average value over a certain time span, as a characteristic value.

12. A pump assembly according to claim 10, wherein the evaluation device is configured upon forming the average value, to weight readings of the concentration sensor in dependence on the readings which are detected by the second sensor and/or in dependence on a time.

13. A pump assembly according to claim 12, wherein the evaluation device is configured upon forming the average value, to weight readings which are detected at a lower temperature higher than readings which are detected at a higher temperature and to effect the weighting according to a linear function or an inverse Sigmoid function.

14. A pump assembly according to claim 1, wherein the evaluation device comprises a neuronal network for evaluating the at least one reading.

15. A pump assembly according to claim 1, wherein the concentration sensor and the second sensor are integrated in a sensor construction unit.

16. A pump assembly according to claim 1, further comprising a third sensor which is configured to detect an operating condition of the pump assembly.

17. A pump assembly according to claim 1, wherein the fluid reservoir is filled with a fluid mixture comprising oil or glycol.

18. A pump assembly according to claim 1, wherein the concentration sensor and the evaluation device are configured for detecting the concentration of water in the fluid reservoir.

19. A pump assembly according to claim 1, wherein the pump assembly is a waste water pump assembly.

20. A pump assembly according to claim 1, wherein the evaluation device is configured to compute or predict a time interval until a next due maintenance of the pump assembly based on the evaluation of the readings of the concentration sensor.

21. A method for detecting a concentration change in a fluid reservoir in a seal arrangement in a pump assembly comprising an electrical drive motor, the seal arrangement with the fluid reservoir, a shaft, at least one impeller connected to the drive motor via the shaft, wherein the shaft extends between the drive motor and the impeller, through the seal arrangement with the fluid reservoir, the method comprising the steps of:

providing a concentration sensor, for detecting a fluid concentration change in the fluid reservoir, arranged in operative communication with the fluid reservoir;

providing a second sensor, for detecting a further parameter of the fluid reservoir, arranged in operative communication with the fluid reservoir;

connecting an evaluation device to each of the concentration sensor and the second sensor, wherein the evaluation device being configured to carry out an evaluation of at least one reading of the concentration sensor taking into account at least one reading by the second sensor; and evaluating, with the evaluation device, a reading of the concentration sensor in dependence on a reading of the second sensor.

22. A method according to claim 21, wherein:

the second sensor is a temperature sensor or a temperature-dependent parameter sensor which detects at least one temperature-dependent parameter; and the evaluation of the at least one reading is skipped if the temperature lies above an upper limit value or below a lower limit value.

23. A method according to claim 21, wherein:

upon evaluation, an average value is formed from a plurality of readings of the concentration sensor;

individual readings are weighted differently depending on a reading of the second sensor and/or in dependence on time.

* * * * *